United States Patent [19]

Wolson et al.

[11] 4,234,449

[45] Nov. 18, 1980

[54] METHOD OF HANDLING RADIOACTIVE ALKALI METAL WASTE

[75] Inventors: Raymond D. Wolson, Lockport; Charles C. McPheeters, Plainfield, both of Ill.

[73] Assignee: The United States of America as represented by the United States Department of Energy, Washington, D.C.

[21] Appl. No.: 43,855

[22] Filed: May 30, 1979

[51] Int. Cl.[3] ..... G21F 9/28

[52] U.S. Cl. ..... 252/301.1 W; 423/2; 423/201; 423/641

[58] Field of Search ..... 423/641, 201, 2; 252/301.1 W

[56] References Cited

U.S. PATENT DOCUMENTS

| | | | |
|---|---|---|---|
| 3,459,493 | 8/1969 | Ross | 423/641 |
| 3,862,296 | 1/1975 | Dotson et al. | 252/301.1 W |
| 4,009,990 | 3/1977 | Bonniaud et al. | 252/301.1 W |
| 4,032,614 | 6/1977 | Lewis | 423/641 |
| 4,152,287 | 5/1979 | Bjorklund et al. | 252/301.1 W |

FOREIGN PATENT DOCUMENTS

| | | | |
|---|---|---|---|
| 264724 | 6/1927 | United Kingdom | 423/641 |

*Primary Examiner*—Deborah L. Kyle

*Attorney, Agent, or Firm*—James E. Denny; Frank H. Jackson; Hugh W. Glenn

[57] ABSTRACT

Radioactive alkali metal is mixed with particulate silica in a rotary drum reactor in which the alkali metal is converted to the monoxide during rotation of the reactor to produce particulate silica coated with the alkali metal monoxide suitable as a feed material to make a glass for storing radioactive material. Silica particles, the majority of which pass through a 95 mesh screen or preferably through a 200 mesh screen, are employed in this process, and the preferred weight ratio of silica to alkali metal is 7 to 1 in order to produce a feed material for the final glass product having a silica to alkali metal monoxide ratio of about 5 to 1.

13 Claims, 2 Drawing Figures

METHOD OF HANDLING RADIOACTIVE ALKALI METAL WASTE

CONTRACTUAL ORIGIN OF THE INVENTION

The invention described herein was made in the course of, or under, a contract with the U.S. Department of Energy.

BACKGROUND OF THE INVENTION

Operation of liquid-metal-cooled fast breeder reactors results in production of radioactive sodium waste material or radioactive sodium and potassium waste material, depending on the liquid coolant used in the reactor. The sources of this radioactive alkali metal include cold-trap disposal, maintenance operations, and fuel-reloading operations. At the end of the useful life of the plant, the entire alkali metal waste of the plant must be handled in such a way as to minimize its impact on the environment and to minimize cost. Any alkali metal that has been exposed to the breeder reactor core for a significant time must be carefully handled and controlled because of its fission-product and activation-product content. Among the options available for disposal of this radioactive alkali metal, the most promising are: (1) disposal in a permanent repository, (2) disposal in a landfill burial site, and (3) reuse in a new breeder reactor. The choices among these options depend on the activity level, the presence or absence of transuranics, and the quantity of alkali metal involved. The first cited option could be suitable for small quantities of alkali metal containing transuranics; the second cited option is available for small quantities of alkali metal with low level radioactivity but without transuranics; and the third cited option is available for large quantities of alkali metal.

Large quantities of alkali metal that have become contaminated by means of significant fuel-coolant interaction could be reused if the alkali metal were decontaminated. In any decontamination operation, such as reflux distillation, a small volume of highly radioactive contaminated alkali metal remains in the original alkali metal treated. This small quantity of highly radioactive alkali metal could then be disposed of in a permanent repository.

In order to prevent the alkali metal from interacting with the environment, final disposal must be in a form stable to the environment such as certain non-metallic compounds. Various types of glasses containing silica and alkali monoxides may be suitable as the stable form for permanent repository. For example, the composition of ordinary window glasses is 17% by weight sodium monoxide, 6% by weight calcium oxide, 1% by weight aluminum oxide with the balance being silica. The volume of this glass made from a given mass of elemental sodium is approximately 3 times the original volume of the sodium metal, but this expansion in volume of waste material is not unacceptable in view of the benefits derived from the product.

While typical or ordinary window glass is not ideal for disposal of radioactive sodium, or radioactive potassium or mixtures of sodium and potassium, from the standpoint of leaching of the fission products by water, other glass compositions are suitable as candidate materials for encapsulation of high-level waste from breeder reactors or for that matter from fuel-reprocessing. These glasses typically contain both silica and sodium or potassium monoxide in various silicon to alkali metal ratios. Additive oxides which may be compounded with the radioactive alkali metal monoxide and the silica generally are selected from the following class of compounds including aluminum, antimony, arsenic, barium, beryllium, boron, cadmium, germanium, lead, magnesium, phosphorus, silicon, vanadium, zinc and zirconium.

Representative prior art which relates to the production of glass or to the purification of sodium includes U.S. Pat. No. 4,032,615 issued June 28, 1977 to Johnson, U.S. Pat. No. 4,032,614 issued June 28, 1977 to Lewis, U.S. Pat. No. 4,017,306 issued Apr. 12, 1977 to Batoux et al., U.S. Pat. No. 3,854,933 issued Dec. 17, 1974 to Furakawa et al., and U.S. Pat. No. 2,527,443 issued Oct. 24, 1952 to Padgitt.

SUMMARY OF THE INVENTION

According to the present invention, radioactive alkali metal is mixed with particulate silicon dioxide (silica) followed by converting the alkali metal to the monoxide to produce particulate silica coated with the alkali metal monoxide which is suitable as a feed material to make a glass stable to the environment for storing the radioactive alkali metal waste material.

It is a principal object of the present invention to provide a method of handling highly radioactive alkali metal that is low in cost, simple to control to allow remote operation, capable of providing easily controlled reactions that produce a product for incorporation into a stable disposable form and at the same time provides a minimum release of radioactivity.

An important object of the present invention is to provide a method of treating radioactive alkali metals or radioactive compounds having an alkali metal cation, the method comprising mixing particulate substrate material and radioactive material, and converting the radioactive material to alkali metal monoxide by reaction with oxygen at a temperature sufficient to initiate the reaction, thereby forming particulate substrate particles coated with alkali metal monoxide.

A further object of the present invention is to provide a method of the type set forth in which the particulate substrate material is particulate silica most of which are sized to pass through a 95 mesh screen and the alkali metal is sodium or potassium or mixtures thereof.

A still further object of the present invention is to provide a method of storing radioactive waste in glass, comprising providing radioactive alkali metals or compounds having an alkali metal cation, mixing particulate silica with the radioactive material, oxidizing the radioactive material to form particulate silica coated with alkali metal monoxide, and fusing the alkali metal monoxide coated silica to form glass.

These and other objects of the present invention will be more readily understood by reference to the accompanying specification taken into conjunction with the drawings, in which:

DETAILED DESCRIPTION OF THE INVENTION

Figure 1:
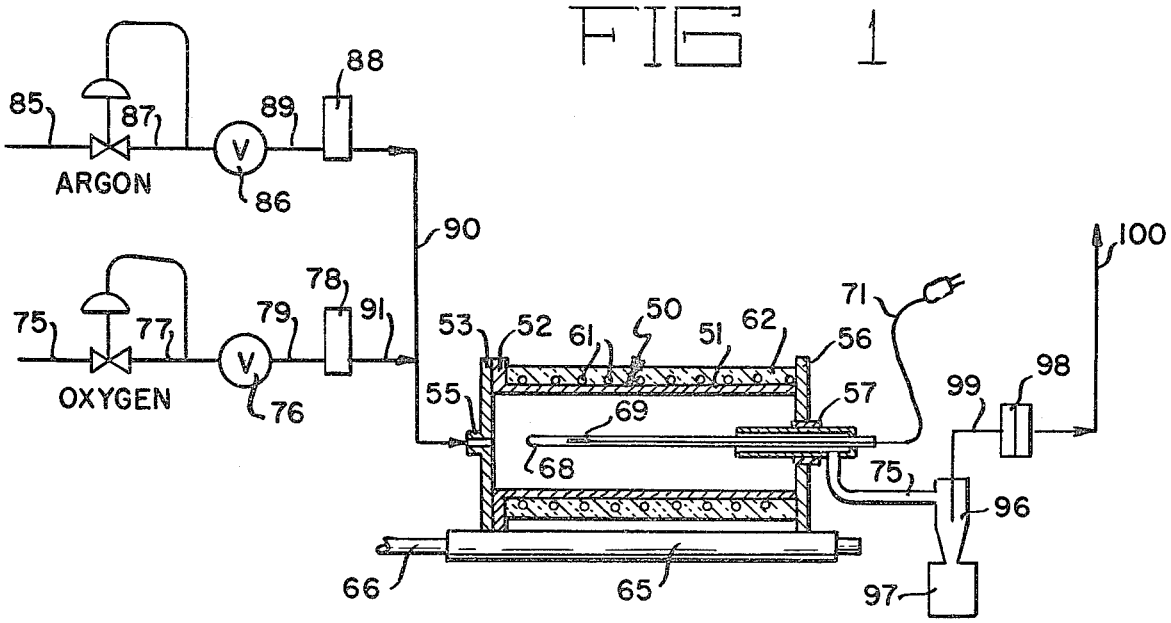
FIG. 1 is a schematic diagram showing the apparatus necessary to produce the silica having an alkali metal monoxide coating.

Referring now to FIG. 1 of the drawings, there is disclosed apparatus used in the direct oxidation of liquid sodium in the presence of particulate silica to form a sodium monoxide coated silica suitable as a feed material for making glass. Although the reported runs were conducted with sodium only, it is clear to those skilled in the art that alkali metals other than sodium are applicable to the subject method as are various mixtures of alkali metals such as sodium and potassium used as a coolant in breeder reactors. In the drawing, a rotary drum reactor (calciner) 50 includes a cylindrical body portion 51 having a circular end flange 52 to which is mated an end plate 53. A plurality of openings (not shown) are evenly spaced about the flange 52 and cover 53 to receive a corresponding plurality of fasteners firmly to seal the cover 53 to the end flange 52. If desirable, a gasket (not shown) may be used intermediate the end flange 52 and the cover 53 to insure an air tight seal. A rotary seal 55 is positioned along the central axis of the end flange 52 and cover 53 and provides communication to the inside of the reactor 50, allowing the introduction of material into the rotary drum reactor during rotation thereof. At the other end of the rotary drum reactor 50 is a circular cover 56 along with another rotary seal 57, positioned axially thereof.

An electrical heater 61 in the form of the usual heating wire is wrapped about the surface of the cylindrical body and is suitably connected to a source of electrical current. Insulation 62 is positioned over the electrical heater 61 so as to reduce the heat loss to the atmosphere.

A roller bar 65 is a ball mill roller having an axial shaft 66 is positioned directly below the rotary drum reactor 50 in frictional contact with both the end flange 52 and cover 53 as well as the cover 56, rotation of the roller bar 65 by a motor (not shown) coupled to the shaft 66 causes rotation of the rotary drum reactor 50 and mixing of materials within the reactor.

A thermocouple well 68 extends into the rotary drum reactor 50 through the seal 57 and houses a thermocouple 69 connected by means of a lead 71 to a suitable electrical connection, thereby to provide an axial temperature profile of the reaction within the rotary drum reactor 50. As may be seen, the thermocouple 69 is movable axially within the housing 68 from one end of the drum 50 to the other end to enable data to be collected incrementally along the longitudinal axis of the drum.

An oxygen source 75 is connected to a valve 76 by a pipe 77, and the valve 76 is connected to a flow meter 78 by a pipe 79. An argon source 85 is connected to a valve 86 by a pipe 87, and the valve 86 is connected to a flow meter 88 by a pipe 89. A pipe 90 from the flow meter 88 is connected to and provides communication with the rotary drum reactor 50; a pipe 91 serves to connect the flow meter 78 to the inlet pipe 90 of the rotary drum reactor 50. Accordingly, both the source of oxygen 75 and the source of argon 85 are connected by the piping routes hereinbefore described to the rotary drum reactor 50.

The rotary drum reactor 50 has an outlet pipe 95 extending through the seal 57 and is connected to a cyclone separator 96 having a bottoms collection plenum 97. A filter 98 is connected by a pipe 99 to the cyclone separator 96 and a pipe 100 is connected to the other end of the filter 98 to vent the filtered gases to the atmosphere, or if desired to a recycling system for further introduction into the rotary drum reactor 50.

In the examples, a mixture of oxygen and argon was passed through the rotary drum reactor 50 without recirculation; however, it is contemplated that recirculation of the oxygen and diluent gas, whether it be argon or nitrogen or other suitable diluent, would be used to eliminate gas effluent carryover. The cyclone separator 96 was used to collect solid materials, that is the sodium monoxide dust, carried over by the gas stream from the rotary drum reactor 50. The rotary drum reactor 50 was fabricated from a straight 150 millimeter internal diameter (6 inch, schedule 40) pipe having a length of 0.5 meter (19 inches) with four straight 25 millimeter wide baffles running axially on the inner wall of the reactor. These baffles were not shown in the drawing. As illustrated, the gas mixture enters reactor 50 through the rotating seal 55 at the center of the end cover 53 and exits through the rotating seal 57 at the other end cover 56. The thermocouple 69 in the thermocouple well 68 allows the axial temperature distribution in the reactor 50 to be determined. During the tests, the drum 50 was rotated at a rate of between 12 and 25 rpm of the ball mill roller 65.

Since one of the objects of the present invention is to produce a feed material for making satisfactory glass for storing radioactive alkali materials, the initial silica-sodium ratio in the examples was chosen to be 7 to 1 in order to yield the silicon dioxide-sodium monoxide ratio of 5 to 1 which is suitable for making a stable glass required to store radioactive materials. All of the examples reported herein started with a total initial charge of 1.3 kilograms consisting of 0.17 kilogram sodium, 1.2 kilogram silica. Two types of silica were tested, one being silica sand between 95 and 100 mesh, that is a material which passed through a 95 mesh screen and was retained on a 100 mesh screen and silica flour which passes through a 200 screen. (Unless otherwise indicated, all screen sizes are given herein as U.S. Sieve Series mesh). In preparing the materials, the silica flour was dried by baking the material at about 200° C. for 7 days. The sodium and the silica were mixed manually in a glove box under a helium atmosphere by heating each of the constituent materials to about 130° C. and pouring the liquid sodium into the silica while stirring the mixture until it had cooled below 80° C. The sodium-silica mixture prepared in this manner was neither sticky nor gummy but was granular, dry and poured easily. Five runs are reported showing the effect of varying the oxygen concentration in the feed gas, the reaction temperature and the silica particle size. The conditions of each run are summarized in Table 1.

TABLE I

| Run No. | Silica Mesh Size | Ar Flow, $cm^3/s$ | $O_2$ Flow,[a] $cm^3/s$ | Temp., °C. Max. | Temp., °C. Final | Duration of Run, min |
|---|---|---|---|---|---|---|
| 1 | −200 | 45 | 9.2 (17%) | 158 | — | [b] |
| 2 | −200 | 27.2 | 14.3 (35%) | 164 | 100 | 105 |
| 3 | −95 +105 | 22.5 | 14.3 (39%) | 212 | 155 | 96 |
| 4 | −95 +105 | 27.2 | 20.3 (43%) | 246 | 110 | 165 |
| 5 | −200 | 10.0 | 14.3 (59%) | 225 | 150 | 94 |

[a]Numbers in parentheses indicate oxygen concentration in feed gas.
[b]Terminated before completion due to excessive carryover.

Referring now to table 1, in the first two runs although it was attempted to start the reaction spontaneously due to the exothermic nature of the oxidation reaction of sodium to sodium monoxide (−45 kcal molNa), it was determined that the spontaneous reaction would not occur even under oxygen pressures as high as 100 kPa (Kilonewtons per square meter) (100 kPa=14.7 psi). In all cases, it was necessary to exceed the melting temperature of sodium (97.8° C.) before the reaction proceeded spontaneously. It is believed that the oxide coating protects the solid sodium from contact with oxygen; however, as the sodium melts, the oxide coating is broken and the reaction is initiated.

Figure 2:
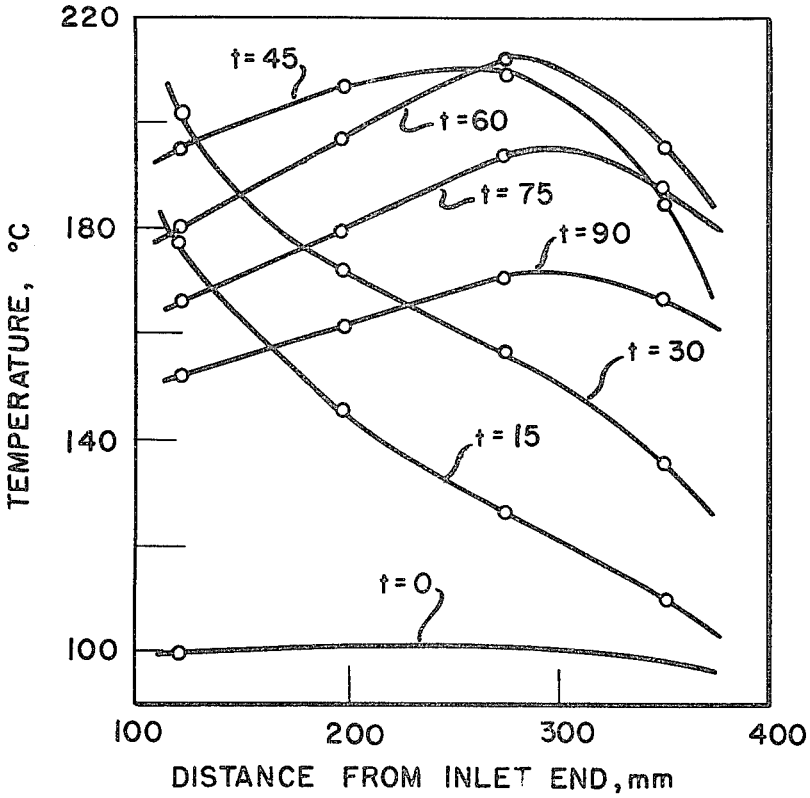
FIG. 2 is a family of curves showing the relationship between temperature and the axial distance from the inlet end of the reactor.

After the reaction was initiated, the reactor temperature increased sharply to a maximum then declined slowly as the metallic sodium became less accessible and the heat loss rate exceeded the heat production rate. The temperature rose more rapidly at the oxygen-inlet end of the reactor as the high temperature peak was observed to travel axially of the reactor from the inlet end early in the run to the outlet end near the completion of the run. This progression of maximum temperature is clearly shown in FIG. 2 wherein the axial temperature profile is plotted at a variety of times during run no. 3.

An important concern in the operation of a rotary drum reactor 50 of the type described or a rotary calciner is the degree of carryover of solids with the gaseous effluent. Varying degrees of solids carryover were observed during the runs, ranging from several grams in the first run to negligable amounts in the later runs, see Table 2 hereinafter set forth. As it was determined that the concentration of oxygen in the argon sweep gas had a negligible effect on the reaction rate, see Table 2, the reaction rate being controlled by the rate of oxygen flow into the reaction chamber, the argon flow rate was reduced to a very low value in the order of 10 cubic centimeters per second to reduce the solids carryover. Whether or not any inert diluent such as argon is required is not clear, except to insure that oxygen reaches all parts of the reactor vessel.

In a fully commercial system, substantially all of the metallic sodium would have to be reacted to the monoxide, while in the samples tested some metallic sodium remained. In these tests, the reaction vessel was allowed to cool down rapidly near the end of the reaction. This explains the fact, as shown in Table 2, that none of the reactions were complete, in the sense that some metallic sodium remained in all of the runs. Nevertheless, the amount of elemental sodium remaining is a critical measurement in carrying out the objects of the present invention, and in order to determine same, two weighed portions of each sample were taken for analysis. One portion was used for determination of total sodium and sodium peroxide. The total sodium was determined by dissolving sodium, sodium monoxide and sodium peroxide in water, filtering the sample to remove the silica particles and thereafter titrating the solution with a standard hydrochloric acid solution. The sodium peroxide was then determined by acidifying the solution and titrating the hydrogen peroxide produced by the reaction of sodium peroxide with water with a standard potassium permanganate solution. Some silica was found to dissolve in the strongly basic solution, but it did not appear to interfere with the total sodium analysis.

The second portion of the sample was heated to a temperature in the range of between about 400° and about 450° C. under vacuum conditions to determine the elemental sodium present by evaporative weight loss. The amount of loss by evaporation was confirmed by dissolving the residue in water and titrating the solution with a standard hydrochloric acid solution, as was done for the total sodium measurement. In all cases, the weight loss correlated well with the difference in total sodium in the untreated sample and in the residue after evaporation.

The results of each run are presented in Table 2 wherein the percent of the original sodium that was converted is expressed as a combination of sodium monoxide and sodium peroxide. The quantity of sodium peroxide is given separately as a percentage of the original sodium, as is the quantity of unreacted sodium. Sodium peroxide is considered an acceptable product for incorporation into the glass. While it is of interest to know the quantity of sodium peroxide formed, its presence in no way detracts from the success of the reaction.

TABLE 2

| Run No. | Na Added, kg | % of Na Reacted to Form $Na_2O + Na_2O_2$[a] | | | % of Na Remaining | | | Carryover, g |
|---|---|---|---|---|---|---|---|---|
| | | Inlet | Middle | Outlet | Inlet | Middle | Outlet | |
| 1 | 0.164 | — | — | — | — | — | — | [b] |
| 2 | 0.173 | 91.9 (7.5) | 92.0 (9.0) | 92.9 (8.8) | 8.1 | 8.0 | 7.1 | 1 |
| 3 | 0.173 | 86.8 (5.5) | 80.6 (10.9) | 85.4 (4.5) | 13.2 | 19.4 | 14.6 | |
| 4 | 0.174 | 82.9 (7.1) | 79.6 (20.6) | 81.0 (8.8) | 17.1 | 20.4 | 19.0 | 3.2 |
| 5 | 0.173 | 83.2 (10.7) | 79.6 (8.9) | 80.6 (9.8) | 16.8 | 20.4 | 19.4 | None |

[a]Values in parentheses are percentages of $Na_2O_2$.
[b]Run terminated due to excessive material carryover. Na analyses not available.

As shown in Table 2, the highest sodium conversion was achieved in run 2, in which −200 mesh silica flour was used. The oxygen input rate was low, and the maximum temperature was maintained at a relatively low 164° C. The total time of the run was 105 minutes, indicating that in a continuous, large-scale process, the residence time in the reactor would be at least 120 minutes.

The conditions that seem to reduce the conversion efficiency were the use of the −95 +105 silica particles, higher operating temperatures and higher oxygen feed rates. Nevertheless, when continued stirring was employed with the −95 +105 silica a satisfactory product was obtained. Since the higher oxygen feed rate results in higher operating temperatures, it is difficult to separate these effects. It is certain, however, that the larger silica particles provide larger volumes between the particles for sodium containment so that it is more difficult for the oxygen to reach all the sodium present in the charge.

As seen, the direct-oxidation method using a silica carrier has been shown to achieve a more than 92% conversion of elemental sodium to the oxide when dry oxygen is used. With the addition of sufficient humidity, 100% conversion should be achievable without difficulty. The material produced, that is sodium monoxide coated silica particles having a weight ratio of silica to sodium monoxide of about 5 to 1, would be suitable as a feed material to make a stable glass for storing radioactive waste containing alkali metal cations.

Table 3 below sets forth an additional summary of the five runs presented in Tables 1 and 2. As noted, supplemental heating was necessary to initiate the reaction in both runs 1 and 2 during which time argon was passed through the system. When the temperature reached approximately 230° F. (110° C.) supplemental heating was stopped and the oxygen flow was started through the rotating drum reactor 50. The drum reactor 50 was turning at 25 rpm in the first run and the oxygen concentration in the gas stream was varied from between 10% to 20% by volume. The highest temperature reached in the first run was 320° F. (160° C.) as reported, the first run being shut down sooner than desired because of excessive carryover of the silicon dioxide and sodium monoxide particulate.

TABLE 3

| Run # | Total Charge (Kg) | $SiO_2$ Particle Size | Percent $O_2$ in sweep Gas | Max Temp. Achieved (°F.) | Percent Conversion of Na to $Na_2O$ & $Na_2O_2$ Inlet | Middle | Outlet |
|---|---|---|---|---|---|---|---|
| 1 | 1.37 | −200 | 10-20 | 316(158° C.) | — | a | — |
| 2 | 1.37 | −200 | 20-60 | 327(164° C.) | 92 | 92 | 92 |
| 3 | 1.37 | +95, −105 | 25-40 | 408(209° C.) | 87 | 81 | 85 |
| 4 | 1.37 | +95, −105 | 40 | 475(246° C. | 82 | 80 | 82 |
| 5 b | 1.37 | −200 | 60 | 435(224° C.) | 83 | 80 | 81 |

a High argon flow and excessive solids carryover. Run stopped prematurely.
b Run terminated early due to seal failure.

Run 2 essentially duplicated run 1 except that the drum 50 was rotated at 12 rpm. The oxygen gas concentration was varied between 20% and 60% by volume with 100% pure oxygen being run at small time intervals during the run. Again 230° F. (110° C.) seemed to be the temperature at which the reaction became self-sustaining.

Run 3 was similar to runs 1 and 2 except that a higher reaction temperature, 392° F. (200° C.), was achieved by wrapping insulation on the drum body 51. The silicon dioxide-sodium charge was slightly different than in runs 1 and 2 in that −105 mesh silica was used instead of the silica flour in the previous runs. By manually stirring the silica-sodium mix until it was cool, with the Inconel sheath 68 of the thermocouple 69, it was found that the sodium monoxide coated silica particles remained separate and poured very nicely.

Runs 4 and 5 show the result of an increase in the volume percent of oxygen in the sweep gas, which translates to a higher reaction temperature. As seen, in runs 5, 60% by volume of oxygen was used which generated a reaction temperature of 435° F. (224° C.), the run being terminated after only about 90 minutes due to the failure of a seal on the rotary drum calciner 50. It is speculated that the percentage conversion reported in Table 3 would have been much higher had the run been allowed to continue. Nevertheless, sodium monoxide coated silica product was uniform and was easily poured out of the drum reactor 50 after termination of the run and is a very easily handled material. The product from the rotary drum 50 produced in runs 4 and 5 has been fabricated into a glass having a composition similar to that given in Battelle Northwest Laboratory Report "Annual Report on the Characteristics of High-Level Waste Glasses," BNWL-2252, page 8, June 1977.

| Component | Percent by Weight |
|---|---|
| $Na_2O$-$SiO_2$ (calciner drum product) | 48 |
| $B_2O_3$ (as $H_3BO_3$) | 15 |
| ZnO | 29 |
| MgO | 2 |
| CaO | 6 |

These materials were heated in a platinum crucible for 70 hours at 2012° F. (1100° C.) and a transparent glass was formed.

Although not tried, the following starting composition also may be suitable for preparing a similar glass for storing radioactive waste material.

| Component | Percent by Weight |
|---|---|
| $SiO_2$ | 34.1 |
| $H_3BO_3$ | 24.6 |
| Na | 7.4 |
| ZnO | 26.5 |
| CaO | 5.5 |
| MgO | 1.8 |

In the above-listed glass, the metallic sodium is expected to react with the boric acid as the mixtures heat. The boric acid normally decomposes on heating, liberating water which will be available to react with any metallic sodium present.

As seen in the foregoing, there has been disclosed a method for producing an alkali metal monoxide coated particulate material which is suitable as feed material to make glass. Also disclosed is a process for converting highly radioactive alkali metal cations into a suitable solid material for storage. It will be apparent to those skilled in the art that various modifications and alterations may be made in the processes disclosed herein without departing from the true spirit and scope of the present invention, and it is intended to cover in the claims appended hereto all such alterations and modifications.

The embodiments of the invention in which an exclusive property or privilege is claimed are defined as follows:

1. A method of treating radioactive aklali metals or radioactive solid salts thereof, said method comprising mixing particulate silica substrate material having a particle size such that the majority of the substrate material passes through a 200 mesh sieve and the radioactive material in a rotary drum calciner and converting the radioactive material to alkali metal monoxide by reaction with oxygen present in a diluent at a temperature sufficient to initiate the reaction thereby forming particulate substrate particles coated with alkali metal monoxide, said reaction temperature being controlled by the amount of oxygen present in the diluent to ensure the reaction product remains flowable for easy handling.

2. The method set forth in claim 1, wherein the alkali metal is sodium or potassium.

3. The method set forth in claim 1, wherein the temperature is at least as high as the melting point of the highest melting alkali metal present but not greater than about 200° C.

4. The method set forth in claim 1, wherein the weight ratio of silica to alkali metal monoxide is about seven to one.

5. The method set forth in claim 1, wherein the particulate substrate material and the radioactive material are continually mixed during the conversion to the monoxide.

6. The method set forth in claim 1, wherein oxygen is present in an amount up to about 20% by volume.

7. A method of treating radioactive sodium or potassium metals or radioactive solid salts thereof, said method comprising mixing silica particles most of which are of a size to pass through a 95 mesh screen and the radioactive material, and oxidizing the radioactive material to the monoxide in a rotary drum calciner by passing oxygen in a diluent over the mixture to form particulate silica coated with sodium monoxide or potassium monoxide or mixtures thereof, the reaction temperature being controlled by the amount of oxygen present in the diluent and being maintained at about 250° C. or less.

8. The method set forth in claim 7, wherein most of the silica present passes through a 200 mesh screen.

9. The method set forth in claim 7, wherein the diluent is argon.

10. A method of storing radioactive waste as glass, comprising providing radioactive alkali metals or solid salts thereof, mixing particulate silica having a particle size the majority of which passes through a 200 mesh screen with the radioactive material, oxidizing the radioactive material in a rotary drum calciner at a temperature less than about 200° C. by passing oxygen in a heavier than air diluent over the mixture to form particulate silica coated with alkali metal monoxide which is easily flowable and fusing said alkali metal monoxide coated silica to form glass.

11. The method set forth in claim 10, wherein the radioactive material has a sodium cation or potassium cation or mixtures thereof.

12. The method set forth in claim 10, wherein the weight ratio of silica to alkali metal monoxide is about five to one.

13. The method set forth in claim 10, wherein the diluent is argon and oxygen is present in an amount not greater than about 20% by volume.

* * * * *